US010856710B2

(12) United States Patent
Zheng et al.

(10) Patent No.: US 10,856,710 B2
(45) Date of Patent: Dec. 8, 2020

(54) BRUSHROLL AND ROBOT VACUUM CLEANER

(71) Applicants: Jiangsu Midea Cleaning Appliances Co., Ltd., Suzhou (CN); Midea Group Co., Ltd., Foshan (CN)

(72) Inventors: Hao Zheng, Suzhou (CN); Fangfei Xiong, Suzhou (CN); Xiaogang Xuan, Suzhou (CN)

( * ) Notice: Subject to any disclaimer, the term of this patent is extended or adjusted under 35 U.S.C. 154(b) by 343 days.

(21) Appl. No.: 16/121,657

(22) Filed: Sep. 5, 2018

(65) Prior Publication Data

US 2019/0307302 A1 Oct. 10, 2019

Related U.S. Application Data

(63) Continuation of application No. PCT/CN2018/098026, filed on Aug. 1, 2018.

(30) Foreign Application Priority Data

Apr. 9, 2018 (CN) ..... 2018 2 0497196 U

(51) Int. Cl.
*A47L 9/04* (2006.01)

(52) U.S. Cl.
CPC ..... *A47L 9/0477* (2013.01); *A47L 2201/00* (2013.01)

(58) Field of Classification Search
CPC ..... A47L 9/0477
See application file for complete search history.

(56) References Cited

U.S. PATENT DOCUMENTS 6,199,244 B1 * 3/2001 Hilgers ..... A47L 9/0477 15/1.51

FOREIGN PATENT DOCUMENTS

| | | |
|---|---|---|
| CN | 204581168 U | 8/2015 |
| CN | 105212841 A | 1/2016 |
| CN | 204950812 U | 1/2016 |
| CN | 206937332 U | 1/2018 |

* cited by examiner

*Primary Examiner* — Andrew A Horton
(74) *Attorney, Agent, or Firm* — Kilpatrick Townsend & Stockton, LLP

(57) ABSTRACT

A brushroll is provided. The brushroll includes a first roller and a second roller. The first roller and the second roller are arranged symmetrically in an axial direction of the brushroll. The first roller is provided with a plurality of first mounting grooves spaced apart and arranged along a circumference of the first roller. The second roller is provided with a plurality of second mounting grooves spaced apart and arranged along a circumference of the second roller. The brushroll includes first brush members inserted in the first mounting grooves and second brush members inserted in the second mounting grooves. A robot vacuum cleaner having the aforementioned brushroll is also provided.

20 Claims, 5 Drawing Sheets

BRUSHROLL AND ROBOT VACUUM CLEANER

PRIORITY

This application is a continuation of International Application No. PCT/CN2018/098026, filed Aug. 1, 2018, which claims priority to and the benefit of Chinese Patent Application No. 201820497196.3 filed in the China's State Intellectual Property Office on Apr. 9, 2018, the entire contents of which are incorporated herein by reference.

FIELD

The present disclosure relates to a technical field of household appliances, and more particularly to a brushroll and a robot vacuum cleaner.

BACKGROUND

In the related art, when a robot vacuum cleaner operates, a brushroll mounted to the robot vacuum cleaner rotates along with the robot vacuum cleaner, and dirt on the ground is hurled into a dust suction port by the rotation of the brushroll, such that the dirt can be sucked into the robot vacuum cleaner more effectively. Moreover, plant fibers of the brushroll can remove the stains on the ground, which will improve the cleaning ability. However, the plant fibers of the existing brushroll have high process requirements, and results in high cost and low efficiency.

SUMMARY

Embodiments can provide a brushroll for a robot vacuum cleaner.

The brushroll according to embodiments can be used in a robot vacuum cleaner. The brushroll according to embodiments may include: a first roller and a second roller. The first roller and the second roller may be arranged symmetrically along an axial direction of the brushroll. The first roller may be provided with a plurality of first mounting grooves spaced apart and arranged along a circumference of the first roller. The second roller may be provided with a plurality of second mounting grooves spaced apart and arranged along a circumference of the second roller. A first brush members may be inserted in the first mounting groove and a second brush members may be inserted in the second mounting groove.

In the brushroll according to embodiments, the first roller and the second roller may be symmetrically arranged. A bottom surface of each first brush members can be inserted in the first mounting groove, and a bottom surface of each second brush members can be inserted in the second mounting groove, whereby the manufacturing cost of the brushroll can be reduced, the installation thereof is facilitated, and the efficiency is high.

The robot vacuum cleaner according to embodiments may include a cleaner body and a brushroll provided to the cleaner body. The brushroll may include: a first roller and a second roller, the first roller and the second roller being mirror-symmetrical in an axial direction of the brushroll and coaxially arranged, the first roller being provided with a plurality of first mounting grooves spaced apart and arranged along a circumferential direction of the first roller, while the second roller being provided with a plurality of second mounting grooves spaced apart and arranged along a circumferential direction of the second roller; a first brush members inserted in the first mounting groove; and a second brush members inserted in the second mounting groove.

In the robot vacuum cleaner according to embodiments, the first roller and the second roller are mirror-symmetrical, a bottom surface of each first brush members can be inserted in the first mounting groove, and a bottom surface of each second brush members can be inserted in the second mounting groove, whereby the manufacturing cost of the brushroll can be reduced, the installation thereof is facilitated, and the efficiency is high.

Additional aspects and advantages of embodiments of present disclosure will be given in part in the following descriptions, become apparent in part from the following descriptions, or be learned from the practice of the embodiments.

BRIEF DESCRIPTION OF THE DRAWINGS

These and/or other aspects and advantages of the present disclosure will become apparent and more readily appreciated from the following descriptions of embodiments made with reference to the drawings, in which.

DETAILED DESCRIPTION

Figure 1:
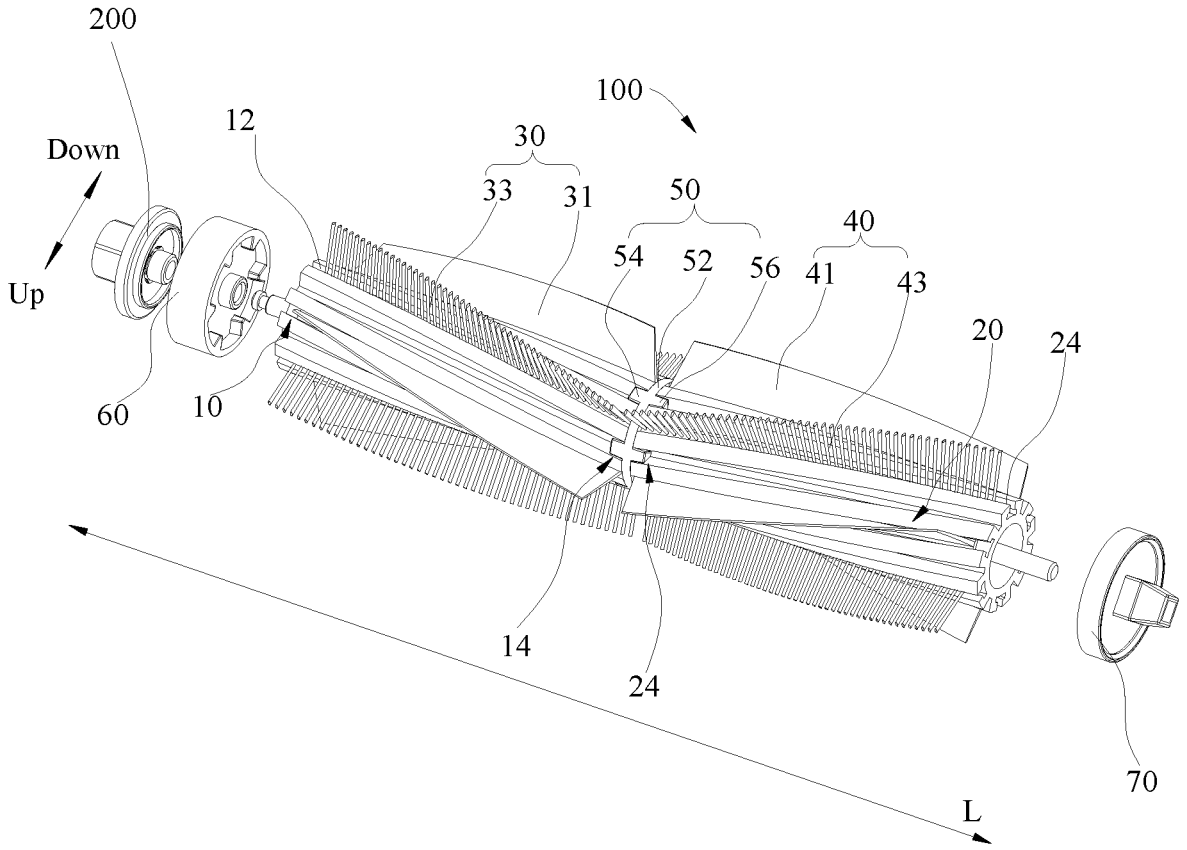
FIG. 1 is a schematic view of a brushroll according to an embodiment of the present disclosure.

Main Reference Numerals robot vacuum cleaner 1000, brushroll 100, first roller 10, first mounting groove 12, first snap groove 14, second roller 20, second mounting groove 22, second snap groove 24, first brush members 30, first mounting portion 32, first dedusting portion 34, first sub-brush body 31, second sub-brush body 33, second brush members 40, second mounting portion 42, second dedusting portion 44, third sub-brush body 41, fourth sub-brush body 43, connecting member 50, disc body 52, first snap block 54, second snap block 56, first end cover 60, second end cover 70, motor rotating cover 200, cleaner body 300, side brush 400.

Further illustration of embodiments will be made with reference to the drawings. The same or similar elements and the elements having same or similar functions are denoted by like reference numerals throughout the descriptions.

In addition, the embodiments described herein with reference to drawings are illustrative, and used to generally understand the present disclosure. The embodiments shall not be construed to limit the present disclosure.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Figure 2:
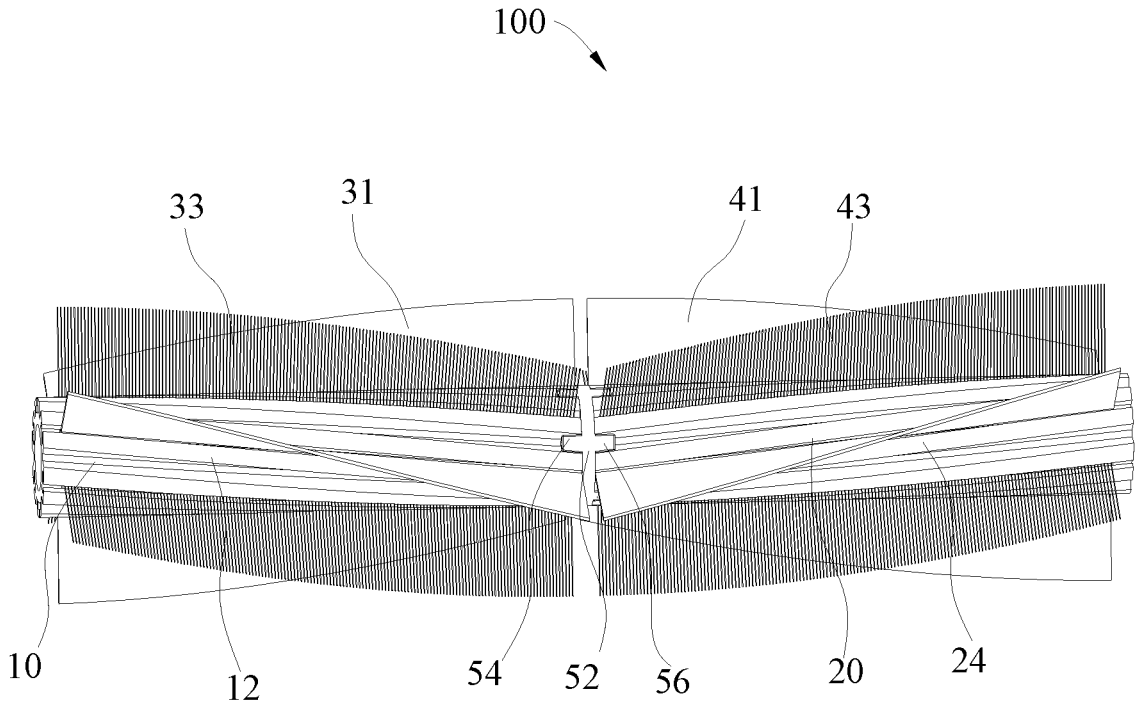
FIG. 2 is another schematic view of a brushroll according to an embodiment of the present disclosure.

Referring to FIGS. 1 and 2, an example brushroll 100 in accordance with the disclosure is illustrated. As shown, the brushroll 100 can include a first roller 10 and a second roller 20. In this example, the first roller 10 and the second roller 20 are arranged symmetrically along an axial direction of the brushroll 100. As shown, the first roller 10 is provided with a plurality of first mounting grooves 12 spaced apart and arranged along a circumference of the first roller 10. The second roller 20 is provided with a plurality of second mounting grooves 22 spaced apart and arranged along a circumference of the second roller 20. The brushroll 100 may include first brush members 30 and a second brush members 40. The first brush members 30 can be inserted in the first mounting groove 12. The second brush members 40 can be inserted in the second mounting groove 22.

In the brushroll 100, the first roller 10 and the second roller 20 are arranged symmetrically. A bottom surface of each first brush members 30 can be inserted in the first mounting groove 12, and a bottom surface of each second brush members 40 can be inserted in the second mounting groove 22. In this way, the manufacturing cost of the brushroll 100 may be reduced, the installation thereof is facilitated, and the efficiency is high.

The first roller 10 and the second roller 20 may be molded in a split manner. The first roller 10 and the second roller 20 may have the same shape and size. However, this is not necessarily the only case. In some examples, the first roller 10 and the second roller 20 may have different shapes and sizes. For example, as shown here, the first roller 10 and the second roller 20 may each have a substantially cylindrical shape. When the brushroll 100 is produced using a mold for the brushroll 100, the first roller 10 and the second roller 20 can be obtained by being rotated out of the same mold reversely. An end of the first roller 10 and an end of the second roller 20 may be connected together by an external element to form one brushroll 100.

In this embodiment, the first roller 10 and the second roller 20 symmetrically arranged such that they are mirrored and coaxially arranged in the axial direction of the brushroll 100. That is, respective central axes of the first roller 10 and the second roller 20 are on the same horizontal plane. The first roller 10 and the second roller 20 are symmetrical in a left-and-right direction of an axial direction of a central axis of the brushroll 100, and the shapes and sizes of the first roller 10 and the second roller 20 are consistent in a mirrored manner. It should be understood, the manner of symmetricity between the first roller 10 and the second roller 20 as illustrated in this example is merely illustrative. One skilled in the art would understand the symmetricity between the first roller 10 and second roller 20 may be achieved in some other ways in accordance with the disclosure.

The first mounting grooves 12 provided in the first roller 10 can be evenly spaced apart in the circumferential direction, and for instance, a circumferential angular difference between the two adjacent first mounting grooves 12 is 30 degrees, 60 degrees or 90 degrees, which will not be limited herein. The second mounting grooves 22 provided in the second roller 20 can be evenly spaced apart in the circumferential direction, and for instance, a circumferential angular difference between the two adjacent second mounting grooves 22 is 30 degrees, 60 degrees or 90 degrees, which will not be limited herein.

The first brush members 30 and the second brush members 40 can both include brush structures for cleaning. In this example, the first brush members 30 may include a leather strip structure and a fur strip structure, each having different cleaning capabilities. The second brush members 40 may also includes a leather strip structure and a fur strip structure, each having different cleaning capabilities. The first brush members 30 may be movable relative to the first mounting groove 12, and the second brush members 40 may be movable relative to the second mounting groove 22. During the production and assembly, the first brush members 30 can be inserted into the first mounting groove 12 along an axial direction of the first mounting groove 12, and the second brush members 40 can be inserted into the second mounting groove 22 along an axial direction of the second mounting groove 22, which leads to high efficiency, convenient installation, and low cost.

Figure 3:
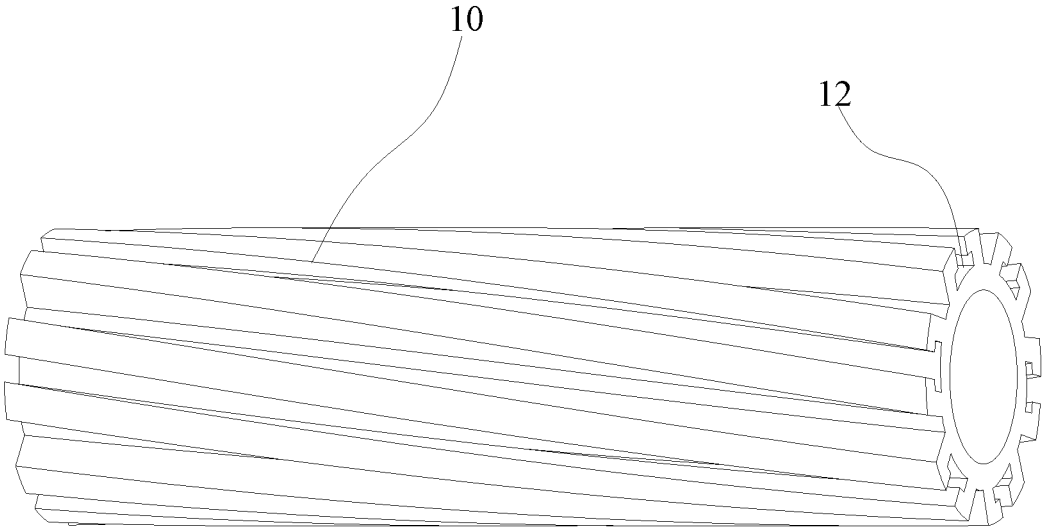
FIG. 3 is a schematic view of a first roller according to an embodiment of the present disclosure.

Referring to FIGS. 1 and 3, as shown, the first mounting grooves 12 can be arranged spirally along an axial direction of the first roller 10, and the second mounting grooves 22 can be arranged spirally along an axial direction of the second roller 20. Along the axial direction of the first roller 10, the spiral direction of the first mounting grooves 12 can be opposite to the spiral direction of the second mounting grooves 22, such that the cleaning ability of the brushroll 100 can be enhanced.

It could be understood that in the axial direction L of the first roller 10 from left to right, the spiral direction of the first mounting grooves 12 is from bottom to top, while the spiral direction of the second mounting grooves 22 is from top to bottom. That is, the spiral direction of the first roller 10 is opposite to the spiral direction of the second roller 20. In addition, during the production of the first roller 10 and the second roller 20, it is only necessary to rotate blanks of the first roller 10 and the second roller 20 in different directions to obtain mounting grooves having the opposite spiral directions, so as to obtain the first roller 10 and the second roller 20.

Figure 4:
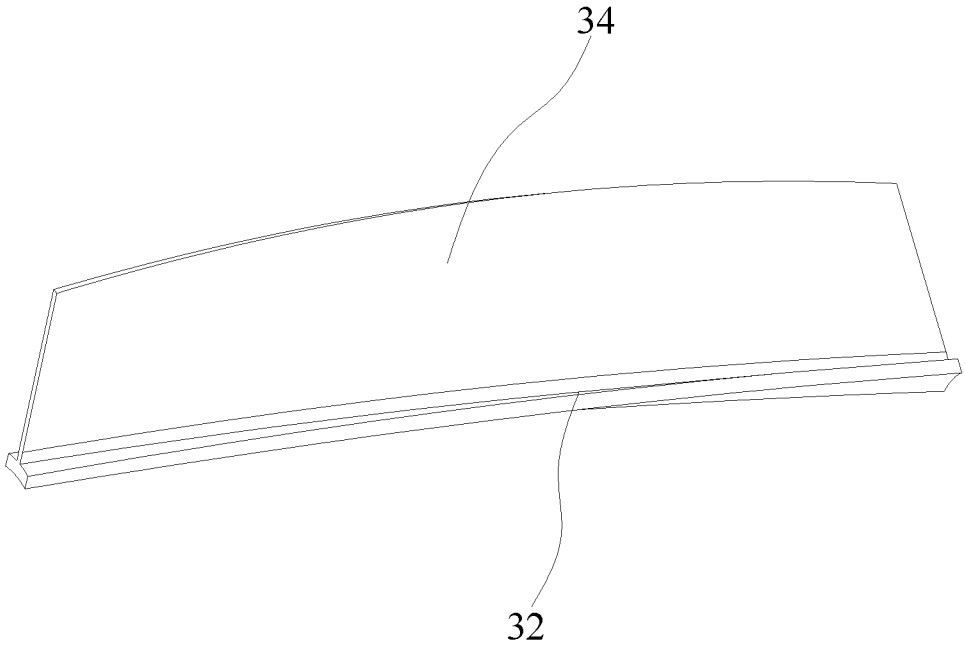
FIG. 4 is a schematic view of a first sub-brush body according to an embodiment of the present disclosure.
Figure 5:
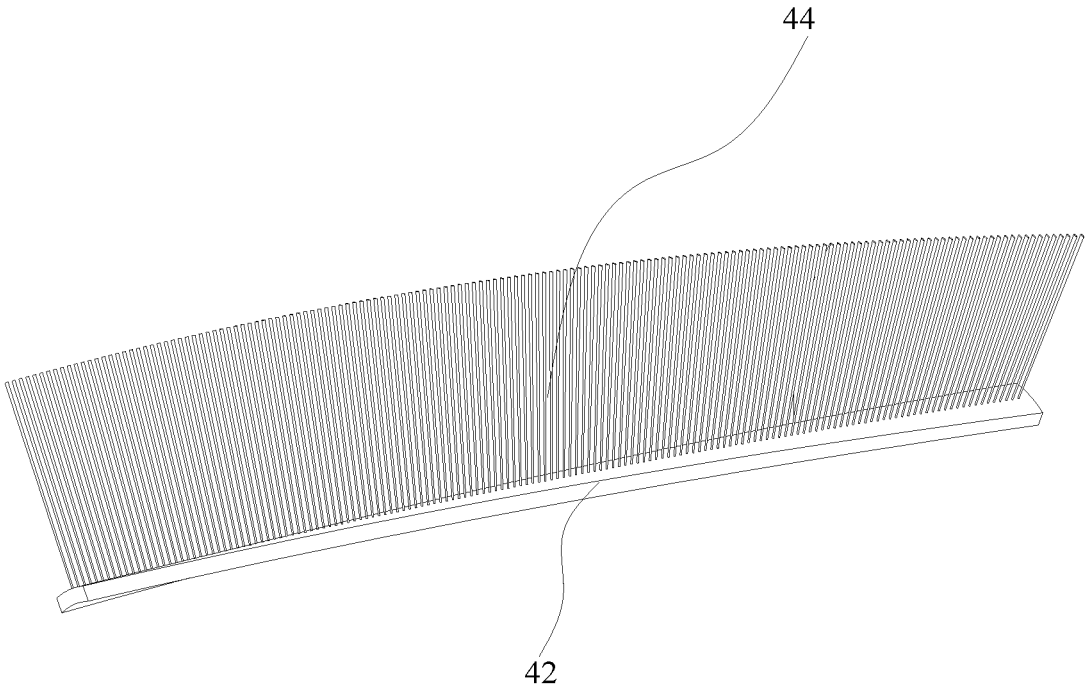
FIG. 5 is a schematic view of a second sub-brush body according to an embodiment of the present disclosure.
Figure 6:
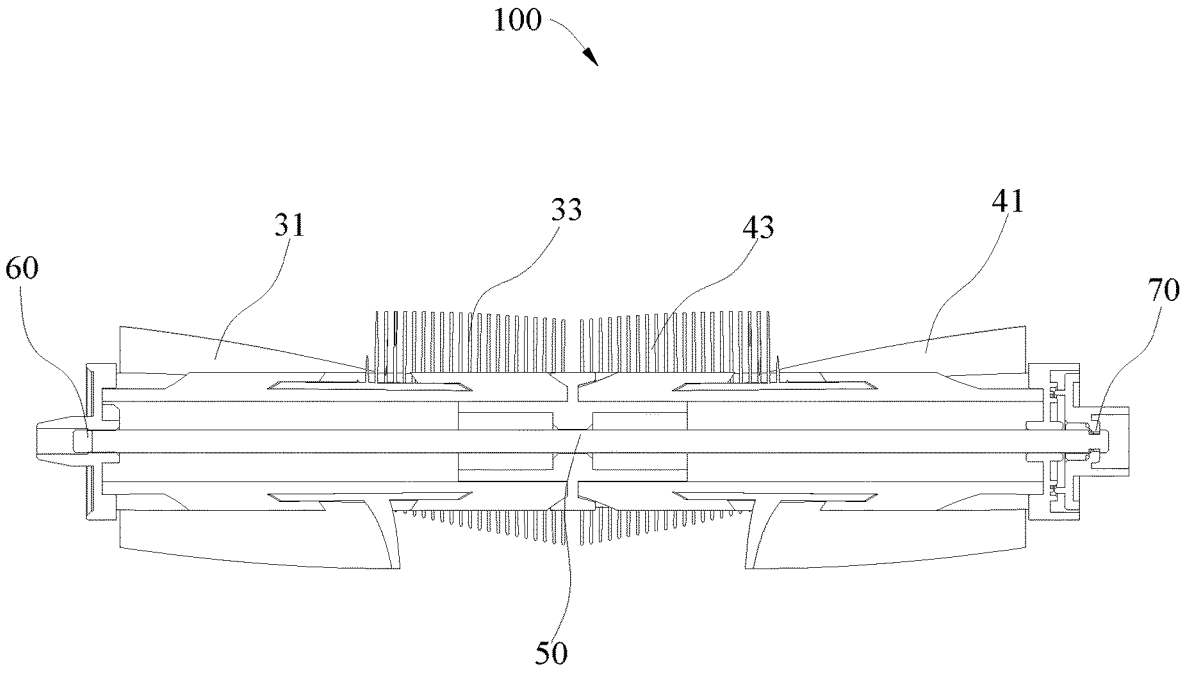
FIG. 6 is a sectional view of a brushroll according to an embodiment of the present disclosure.

Referring to FIGS. 1, 4 and 5, as shown, the first brush members 30 can include a first mounting portion 32 and a first dedusting portion 34 provided to the first mounting portion 32. The first brush members 30 can be inserted in the first mounting groove 12 through the first mounting portion 32. Similarly, the second brush members 40 can include a second mounting portion 42 and a second dedusting portion 44 provided to the second mounting portion 42. The second brush members 40 can be inserted in the second mounting groove 22 through the second mounting portion 42.

In this way, the first brush members 30 can be quickly mounted into the first mounting groove 12 through the first mounting portion 32, and the second brush members 40 can be quickly mounted into the second mounting groove 22 through the second mounting portion 42, which brings about high efficiency and low cost.

As shown, the first dedusting portion 34 can be attached to the first mounting portion 32 by means of an adhesive, and the second dedusting portion 44 can also be adhered to the second mounting portion 42 by means of an adhesive. In another embodiment, the first dedusting portion 34 can be mounted to the first mounting portion 32 by mechanical pressing, and the second dedusting portion 44 can also be mounted to the second mounting portion 42 by mechanical pressing.

Referring to FIG. 1, as shown, the first brush members 30 can include a first sub-brush body 31 and a second sub-brush body 33. As shown, the first sub-brush body 31 and the second sub-brush body 33 can be alternately inserted in the first mounting grooves 12 along the circumference of the first roller 10. The first dedusting portion 34 of the first sub-brush body 31 may have greater rigidity than the first dedusting portion 34 of the second sub-brush body 33. The second brush members 40 can include a third sub-brush body 41 and a fourth sub-brush body 43, and the third sub-brush body 41 and the fourth sub-brush body 43 can be alternately inserted in the second mounting grooves 22 along the circumference of the second roller 20. The second dedusting portion 44 of the third sub-brush body 41 may have greater rigidity than the second dedusting portion 44 of the fourth sub-brush body 43.

Thus, the brushroll 100 can adapt to different types of floor to be cleaned, thereby resulting in good user experience.

It could be understood that the first sub-brush body 31 and the second sub-brush body 33 may be alternately inserted in the first mounting grooves 12 along the circumference of the first roller 10. In one embodiment, the first sub-brush body 31 and the second sub-brush body 33 are evenly and alternately inserted in the first mounting grooves 12 along the circumference of the first roller 10. That is, the circumferential angular difference between the adjacent first sub-brush body 31 and the second sub-brush body 33 is consistent. In some embodiments, the circumferential angular difference between the adjacent first sub-brush body 31 and the second sub-brush body 33 can be 60 degrees. Likewise, the third sub-brush body 41 and the fourth sub-brush body 43 can be alternately inserted in the second mounting grooves 22 along the circumferential direction of the second roller 20. In one embodiment, the third sub-brush body 41 and the fourth sub-brush body 43 are evenly and alternately inserted in the second mounting grooves 22 along the circumference of the second roller 20. That is, the circumferential angular difference between the adjacent third sub-brush body 41 and the fourth sub-brush body 43 is consistent. Preferably, the circumferential angular difference between the adjacent third sub-brush body 41 and the fourth sub-brush body 43 is 60 degrees.

Further, the rigidity of the first dedusting portion 34 of the first sub-brush body 31 may be greater than the rigidity of the first dedusting portion 34 of the second sub-brush body 33. That is, the cleaning force of the first dedusting portion 34 of the first sub-brush body 31 can be greater than the cleaning force of the first dedusting portion 34 of the second sub-brush body 33. The different rigidity of the first sub-brush body 31 and the second sub-brush body 33 enables the brushroll 100 to adapt to different floor types during the cleaning. Likewise, the rigidity of the second dedusting portion 44 of the third sub-brush body 41 can be greater than the rigidity of the second dedusting portion 44 of the fourth sub-brush body 43. That is, the cleaning force of the second dedusting portion 44 of the third sub-brush body 41 can be greater than the cleaning force of the second dedusting portion 44 of the fourth sub-brush body 43. The different rigidity of the third sub-brush body 41 and the fourth sub-brush body 43 enables the brushroll 100 to adapt to different floor types during the cleaning.

In some embodiments, the first sub-brush body 31 can include a leather strip for cleaning, and the integral leather strip can be directly mounted to the first mounting portion 32. The second sub-brush body 33 can include fur strips for cleaning, and the fur strips can be mounted to the first mounting portion 32. The third sub-brush body 41 can include a leather strip for cleaning, and the whole leather strip can be directly mounted to the second mounting portion 42. The fourth sub-brush body 43 can include fur strips for cleaning, and the fur strips can be mounted to the second mounting portion 42.

In one embodiment, three first sub-brush bodies 31 and three second sub-brush bodies 33 are provided, and meanwhile, three third sub-brush bodies 41 and three fourth sub-brush bodies 43 are provided. In another embodiment, three first sub-brush bodies 31 and three second sub-brush bodies 33 are provided. In yet another embodiment, three third sub-brush bodies 41 and three fourth sub-brush bodies 43 are provided.

Thus, the brushroll 100 can have an improved cleaning ability, a simple structure, and low costs.

It could be understood that a circumferential angular different between adjacent two second sub-brush bodies 33 is 120 degrees; a circumferential angular different between adjacent two third sub-brush bodies 41 is 120 degrees; a circumferential angular different between adjacent two fourth sub-brush bodies 43 is 120 degrees.

In one embodiment, an end of the second sub-brush body 33 away from the first roller 10 is higher than an end of the first sub-brush body 31 away from the first roller 10, and meanwhile, an end of the third sub-brush body 41 away from the second roller 20 is higher than an end of the fourth sub-brush body 43 away from the second roller 20. In another embodiment, an end of the second sub-brush body 33 away from the first roller 10 is higher than an end of the first sub-brush body 31 away from the first roller 10. In yet another embodiment, an end of the third sub-brush body 41 away from the second roller 20 is higher than an end of the fourth sub-brush body 43 away from the second roller 20.

Thus, the cleaning ability of the brushroll 100 can be improved, and the brushroll 100 can adapt to different floor types during the cleaning.

In some embodiments, the height of the second sub-brush body 33 is higher than the height of the first sub-brush body 31 by 0.4 mm. In some embodiments, the height of the fourth sub-brush body 43 is higher than the height of the third sub-brush body 41 by 0.4 mm. However, this is not intended to be limiting. The height difference between the first sub-brush body 31 and the second sub-brush body 33 can be determined based on actual requirements, which will not be limited herein. Likewise, the height difference between the third sub-brush body 41 and the fourth sub-brush body 43 can be determined based on actual requirements, which will not be limited herein.

Referring to FIGS. 1 and 3, as shown, the first mounting groove 12 can be a T-shaped groove, and the second mounting groove 22 is a T-shaped groove, such that the first brush members 30 can be easily inserted in the first mounting groove 12, and the second brush members 40 can be easily inserted in the second mounting groove 22.

Referring to FIGS. 1 and 2, as shown, the brushroll 100 can include a connecting member 50 that connects the first roller 10 and the second roller 20, and the connecting member 50 is used to limit relative rotation of the first roller 10 and the second roller 20. Thus, the interconnection between the first roller 10 and the second roller 20 can be achieved through the connecting member 50, which makes the structure simple.

In some embodiments, the connecting member 50 may be a separate component, and two ends of the connecting member 50 are connected to the first roller 10 and the second roller 20, respectively. The diameter of the connecting member 50 can be consistent with the diameter of the first roller 10 and the diameter of the second roller 20. In one embodiment, the connecting member 50 may exhibit a circular ring shape.

Referring to FIGS. 1 and 2, in certain embodiments, the connecting member 50 includes a disc body 52, a first snap block 54, and a second snap block 56. The first snap block 54 and the second snap block 56 are provided to two opposite sides of the disc body 52. The first roller 10 is provided with a first snap groove 14, and the second roller 20 is provided with a second snap groove 24. The first snap block 54 is snap-fitted in the first snap groove 14, and the second snap block 56 is snap-fitted in the second snap groove 24.

Thus, the first roller 10 and the second roller 20 can be easily secured together through the fitting between the first snap block 54 and the first snap groove 14 and the fitting between the second snap block 56 and the second snap groove 24.

As shown, a plurality of first snap blocks 54 can be provided and evenly spaced, and a plurality of second snap blocks 56 can be provided and evenly spaced. The numbers of the first snap blocks 54 and the second snap blocks 56 are not limited herein, and can be determined based on actual requirements.

It could be understood that an end of the first roller 10 is provided with the first snap groove 14 away from the second roller 20, that is, the first snap groove 14 can be perpendicular to a sectional direction of the disc body 52. An end of the second roller 20 is provided with the second snap groove 24 away from the first roller 10, that is, the second snap groove 24 can be perpendicular to the sectional direction of the disc body 52.

Figure 7:
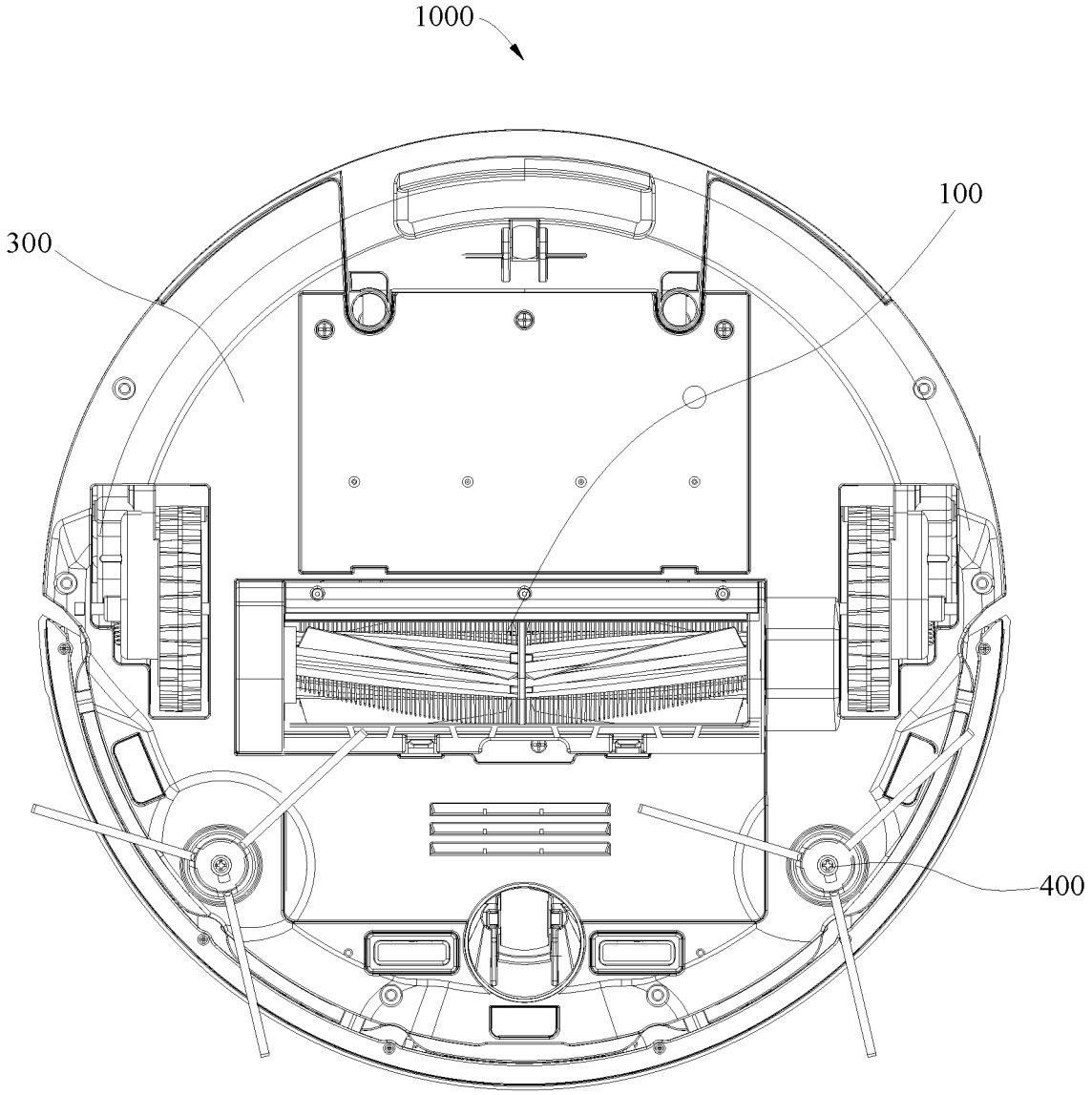
FIG. 7 is a bottom view of a robot vacuum cleaner according to an embodiment of the present disclosure.

Referring to FIG. 7, embodiments in accordance with the disclosure can provide a robot vacuum cleaner 1000. The robot vacuum cleaner 1000 can include the brushroll 100 described herein. As shown, the brushroll 100 is mounted to a cleaner body 300. The cleaner body 300 can include a motor (not illustrated), and the motor is used to drive the brushroll 100 to rotate.

In the robot vacuum cleaner 1000, the first roller 10 and the second roller 20 are symmetrically arranged. The bottom surface of each first brush members 30 can be inserted in the first mounting groove 12, and the bottom surface of each second brush members 40 can be inserted in the second mounting groove 22, whereby the manufacturing cost of the brushroll 100 can be reduced, the installation thereof is facilitated, and the efficiency is high.

In some embodiments, the robot vacuum cleaner 1000 can include a motor rotating cover 200, the motor rotating cover 200 is connected with the motor, and the motor rotating cover 200 can be driven to rotate when the motor rotates. In some embodiments, the brushroll 100 can include a first end cover 60 and a second end cover 70. The first end cover 60 can be connected with the motor rotating cover 200 and the first roller 10, and the second end cover 70 can be connected with the second roller 20.

The robot vacuum cleaner 1000 may include a side brush 400 (not illustrated). The cleaner body 300 may be formed in a circular or substantially square shape, and the cleaner body 300 may be a plastic cleaner body. A front side of the cleaner body 300 can be provided with a bumper (not illustrated), and a spring can be provided between the bumper and the cleaner body 300, such that the spring can buffer a collision force exerted on the robot vacuum cleaner 1000 after the cleaner body 300 collides with any barriers.

A dust cup (not illustrated) can be provided in the cleaner body 300 and have at least one layer of filtration structure. A dust suction port (not illustrated) is provided in a bottom surface of the cleaner body 300, and can be in communication with the dust cup. A vacuum motor for generating a negative pressure can be arranged at a rear side of the dust cup, and under the action of the vacuum motor, dust can be sucked into the dust cup from the dust suction port. After a user uses the robot vacuum cleaner 1000 for a certain period of time, the dust cup can be taken out from the cleaner body 300 of the robot vacuum cleaner 1000, and the dust can be dumped. Meanwhile, the user can also regularly clean the dust cup and the filtration structure.

A wheel (not illustrated) can be provided at each of two sides of the dust cup, and each wheel can be driven by a separate drive motor (not illustrated). In front of a middle position of the two wheels, an omni-directional wheel having support and steering functions can also be provided. However, the present disclosure is not limited thereto.

The side brush 400 can be provided to a bottom of the cleaner body 300 and located at a front side of the two wheels. The side brush 400 can be driven by a separate motor. The side brush 400 can collect dust at the bottom of the cleaner body 300 and the sides of the cleaner body 300 to the dust suction port, so that the dust can be sucked into the dust cup more efficiently.

Reference throughout this specification to "certain embodiments," "an embodiment," "some embodiments," "an exemplary embodiment," "an example," "specific examples" or "some examples" means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

Although embodiments have been shown and illustrated, it shall be understood by those skilled in the art that the above embodiments are illustrative, and various changes, modifications, alternatives and variations without departing from the scope of the present disclosure are acceptable. The scope of the present disclosure is defined by the claims or the like.

What is claimed is:

1. A brushroll for a robot vacuum cleaner, comprising:

a first roller;

a second roller;

a connecting member configured to connect the first roller and the second roller first brush members; and second brush members; and, wherein the first roller and the second roller are arranged symmetrically in an axial direction of the brushroll, the first roller is provided with first mounting grooves spaced apart and arranged along a circumference of the first roller, the second roller is provided with second mounting grooves spaced apart and arranged along a circumference of the second roller;

the first brush members are inserted into the first roller via the first mounting grooves;

the second brush members are inserted into the second roller via the second mounting grooves;

the first roller and the second roller constitute a body of the brushroll when they are connected via the connecting member; and the first roller and the second roller are separately removable from the connecting member and thus from the brushroll.

2. The brushroll according to claim 1, wherein the first mounting grooves are arranged spirally along the circumference of the first roller, the second mounting grooves are arranged spirally along the circumference of the second roller, wherein a spiral direction of the first mounting grooves is opposite to the spiral direction of the second mounting grooves.

3. The brushroll according to claim 1, wherein a given one of the first brush members comprise a first mounting portion and a first dedusting portion provided to the first mounting portion, and the first brush members are inserted into the first mounting grooves through the first mounting portions of the first brush members;

a given one of the second brush members comprise a second mounting portion and a second dedusting portion provided to the second mounting portion, and the second brush members are inserted in the second mounting grooves through the second mounting portions of the second brush members.

4. The brushroll according to claim 3, wherein the first brush members comprise a first sub-brush body and a second sub-brush body, wherein the first sub-brush body and the second sub-brush body are alternately inserted in the first mounting grooves along the circumference of the first roller, and the first dedusting portion of the first sub-brush body has a greater rigidity than the first dedusting portion of the second sub-brush body; and the second brush members comprise a third sub-brush body and a fourth sub-brush body, wherein the third sub-brush body and the fourth sub-brush body are alternately inserted in the second mounting grooves along the circumference of the second roller, and the second dedusting portion of the third sub-brush body has a greater rigidity than the second dedusting portion of the fourth sub-brush body.

5. The brushroll according to claim 4, wherein the first brush members comprise three first sub-brush bodies and three second sub-brush bodies; and the second brush members comprise three third sub-brush bodies and three fourth sub-brush bodies.

6. The brushroll according to claim 4, wherein an end of the second sub-brush body away from the first roller is higher than an end of the first sub-brush body away from the first roller; and an end of the third sub-brush body away from the second roller is higher than an end of the fourth sub-brush body away from the second roller.

7. The brushroll according to claim 1, wherein a given one of the first mounting groove is a T-shaped groove, and a given one of the second mounting groove is a T-shaped groove.

8. The brushroll according to claim 1, wherein the connecting member is further configured to limit relative rotation of the first roller and the second roller.

9. The brushroll according to claim 8, wherein the connecting member comprises a disc body, a first snap block, and a second snap block, and the first snap block and the second snap block are provided to two opposite sides of the disc body; and, wherein the first roller is provided with a first snap groove, and the second roller is provided with a second snap groove, wherein the first snap block is snap-fitted in the first snap groove, while the second snap block is snap-fitted in the second snap groove.

10. A robot vacuum cleaner, comprising a cleaner body, a bumper configured to buffer a collision force exerted on the robot vacuum cleaner, and a brushroll provided to the cleaner body, wherein the brushroll comprises:

a first roller;

a second roller;

a connecting member configured to connect the first roller and the second roller first brush members; and second brush members; and, wherein the first roller and the second roller are arranged symmetrically in an axial direction of the brushroll, the first roller is provided with first mounting grooves spaced apart and arranged along a circumference of the first roller, the second roller is provided with second mounting grooves spaced apart and arranged along a circumference of the second roller;

the first brush members are inserted into the first roller via the first mounting grooves;

the second brush members are inserted into the second roller via the second mounting grooves;

the first roller and the second roller constitute a body of the brushroll when they are connected via the connecting member; and the first roller and the second roller are separately removable from the connecting member and thus from the brushroll.

11. The robot vacuum cleaner according to claim 10, wherein the first mounting grooves are arranged spirally along the circumference of the first roller, the second mounting grooves are arranged spirally along the circumference of the second roller, wherein a spiral direction of the first mounting grooves is opposite to the spiral direction of the second mounting grooves.

12. The robot vacuum cleaner according to claim 10, wherein a given one of the first brush members comprise a first mounting portion and a first dedusting portion provided to the first mounting portion, and the first brush members are inserted into the first mounting grooves through the first mounting portions of the first brush members;

a given one of the second brush members comprise a second mounting portion and a second dedusting portion provided to the second mounting portion, and the second brush members are inserted in the second mounting grooves through the second mounting portions of the second brush members.

13. The robot vacuum cleaner according to claim 12, wherein the first brush members comprise a first sub-brush body and a second sub-brush body, wherein the first sub-brush body and the second sub-brush body are alternately inserted in the first mounting grooves along the circumference of the first roller, and the first dedusting portion of the first sub-brush body has a greater rigidity than the first dedusting portion of the second sub-brush body; and the second brush members comprise a third sub-brush body and a fourth sub-brush body, wherein the third sub-brush body and the fourth sub-brush body are alternately inserted in the second mounting grooves along the circumference of the second roller, and the second dedusting portion of the third sub-brush body has a greater rigidity than the second dedusting portion of the fourth sub-brush body.

14. The robot vacuum cleaner according to claim 13, wherein the first brush members comprise three first sub-brush bodies and three second sub-brush bodies; and the second brush members comprise three third sub-brush bodies and three fourth sub-brush bodies.

15. The robot vacuum cleaner according to claim 13, wherein an end of the second sub-brush body away from the first roller is higher than an end of the first sub-brush body away from the first roller; and an end of the third sub-brush body away from the second roller is higher than an end of the fourth sub-brush body away from the second roller.

16. The robot vacuum cleaner according to claim 10, wherein a given one of the first mounting groove is a T-shaped groove, and a given one of the second mounting groove is a T-shaped groove.

17. The robot vacuum cleaner according to claim 10, wherein the connecting member is further configured to limit relative rotation of the first roller and the second roller.

18. The robot vacuum cleaner according to claim 17, wherein the connecting member comprises a disc body, a first snap block, and a second snap block, and the first snap block and the second snap block are provided to two opposite sides of the disc body; and, wherein the first roller is provided with a first snap groove, and the second roller is provided with a second snap groove, wherein the first snap block is snap-fitted in the first snap groove, while the second snap block is snap-fitted in the second snap groove.

19. A robot vacuum cleaner, comprising a cleaner body, a bumper configured to buffer a collision force exerted on the robot vacuum cleaner, and a removable brushroll provided to the cleaner body, wherein the brushroll comprises:

a first roller;

a second roller;

a connecting member configured to connect the first roller and the second roller;

first brush members; and second brush members; wherein the first roller and the second roller are arranged symmetrically in an axial direction of the brushroll, the first roller is provided with first mounting grooves spaced apart and arranged along a circumference of the first roller, the second roller is provided with second mounting grooves spaced apart and arranged along a circumference of the second roller;

the first brush members are inserted into the first roller via the first mounting grooves;

the second brush members are inserted into the second roller via the second mounting grooves; and the first brush members are made of a material different the second brush members.

20. The robot vacuum cleaner according to claim 19, wherein the connecting member comprises a disc body, a first snap block, and a second snap block, and the first snap block and the second snap block are provided to two opposite sides of the disc body; and, wherein the first roller is provided with a first snap groove, and the second roller is provided with a second snap groove, wherein the first snap block is snap-fitted in the first snap groove, while the second snap block is snap-fitted in the second snap groove, the first snap groove being between the adjacent two first mounting grooves, the second snap groove being between the adjacent two second mounting grooves.

* * * * *